US007004058B2

(12) United States Patent
Thebault et al.

(10) Patent No.: US 7,004,058 B2
(45) Date of Patent: Feb. 28, 2006

(54) PROJECTILE RAMMING DEVICE

(75) Inventors: Didier Thebault, Bourges (FR); Dominique Guesnet, Laslande (FR); Laurent Le Grand, Mehun (FR)

(73) Assignee: Giat Industries, (FR)

( * ) Notice: Subject to any disclaimer, the term of this patent is extended or adjusted under 35 U.S.C. 154(b) by 85 days.

(21) Appl. No.: 10/476,144

(22) PCT Filed: Apr. 26, 2002

(86) PCT No.: PCT/FR02/01451

§ 371 (c)(1),
(2), (4) Date: Oct. 28, 2003

(87) PCT Pub. No.: WO02/097355

PCT Pub. Date: Dec. 5, 2002

(65) Prior Publication Data

US 2004/0139848 A1 Jul. 22, 2004

(30) Foreign Application Priority Data

Apr. 30, 2001 (FR) ..... 01 05784

(51) Int. Cl.
*F41A 15/00* (2006.01)

(52) U.S. Cl. ..... 89/47; 89/1.801; 89/1.805; 89/33.01; 89/45

(58) Field of Classification Search ..... 89/47, 89/1.801, 1.805, 45, 33.01
See application file for complete search history.

(56) References Cited

U.S. PATENT DOCUMENTS

| | | | | |
|---|---|---|---|---|
| 3,296,931 A | | 1/1967 | Christiansson | 89/47 |
| 3,584,532 A | | 6/1971 | Stoner et al. | 89/47 |
| 3,602,089 A | * | 8/1971 | Beaufrere | 89/47 |
| 3,618,453 A | | 11/1971 | Cornelison | 89/1.804 |
| 4,381,693 A | * | 5/1983 | Dumez | 89/36.13 |
| 4,957,028 A | * | 9/1990 | Lieberum et al. | 89/47 |
| 5,168,121 A | * | 12/1992 | Maynard | 89/45 |
| 5,390,583 A | * | 2/1995 | Berglund | 89/47 |
| 6,457,397 B1 | * | 10/2002 | Guesnet et al. | 89/46 |
| 6,772,669 B1 | * | 8/2004 | Stålhandske et al. | 89/47 |

FOREIGN PATENT DOCUMENTS

| | | |
|---|---|---|
| DE | 149402 | 4/1904 |
| DE | 195684 | 3/1908 |
| DE | 207621 | 3/1909 |
| WO | WO 90/15300 | 12/1990 |

* cited by examiner

*Primary Examiner*—M. Clement
(74) *Attorney, Agent, or Firm*—Steptoe & Johnson LLP

(57) ABSTRACT

The invention concerns a device (1) for artillery intended to ram a projectile (7) into the chamber of a weapon barrel, such device comprising an impulse jack (12) incorporating a mobile rod (25) driving a carriage (10) mounted able to slide with respect to a chute (11), the carriage (10) being able to drive the projectile towards the weapon chamber using drive means (9).

Figure 1:
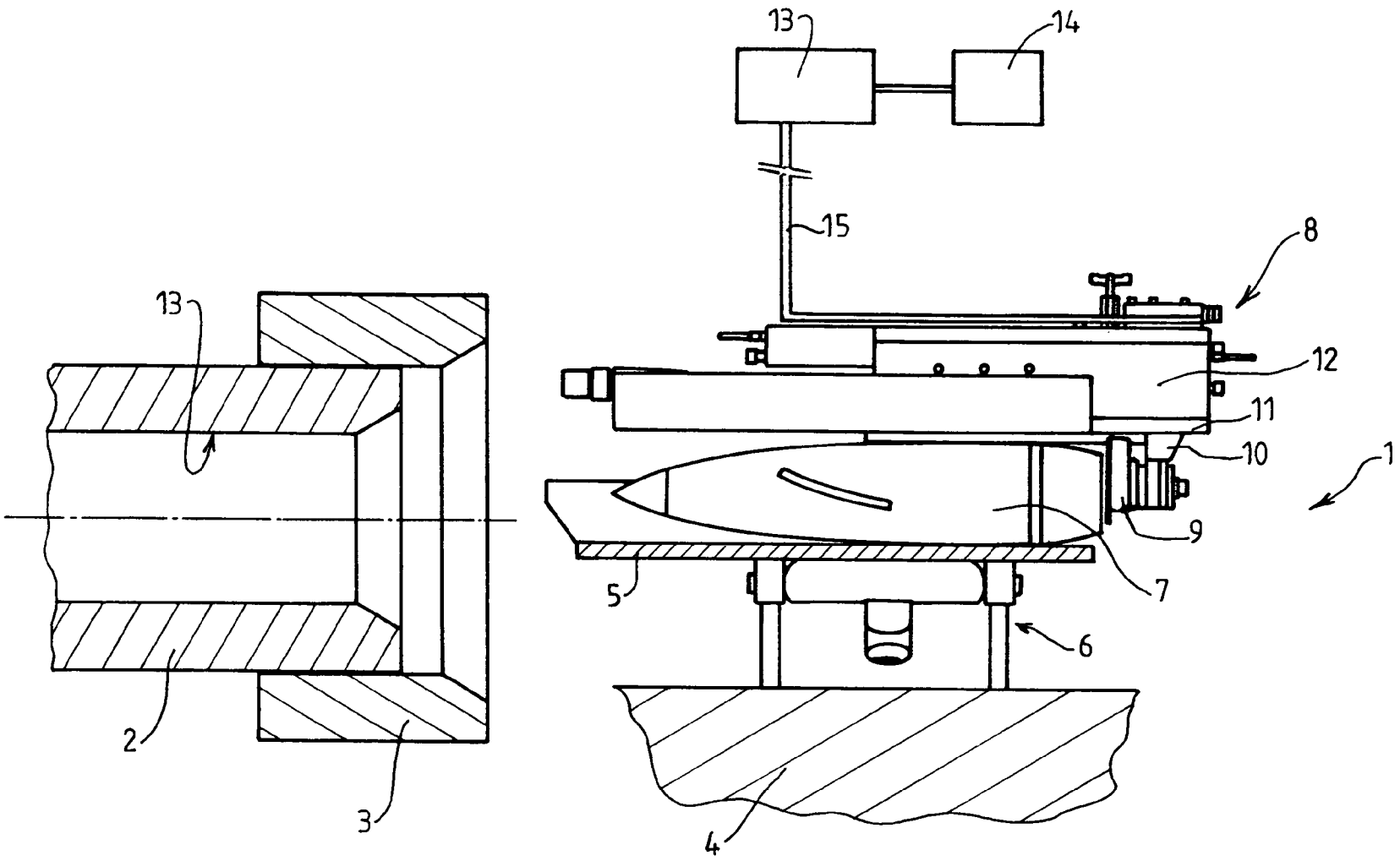

This device comprises a loading tray (5) intended to receive the projectile, such loading tray with respect to which the carriage (10) may translate to drive the projectile (7) and wherein the impulse jack (12) is a dual-acting jack and it is the withdrawal movement of the mobile rod (25) that is used to drive the projectile.

12 Claims, 8 Drawing Sheets

18
28
34
39
36
27
26
25
30a
33
37
30b
16
38
35

PROJECTILE RAMMING DEVICE

The technical scope of the present invention is that of ramming devices for artillery intended to ram projectiles, especially large calibre projectiles namely for field artillery, into position.

To load an artillery cannon before firing, a projectile must be rammed into the barrel and pushed up to the forcing cone. These projectiles, which weigh fifty kilograms or so, must be pushed into position at a speed that is enough to wedge them in the forcing cone such as to prevent them from dropping back and ensuring their gas-tightness, and this whatever the elevation position of the cannon.

Several ramming methods and devices are known. The oldest method consists in manually introducing the projectiles. This method has many drawbacks, in particular the slow ramming speed, the involvement of several operators, the necessity of having to lower the barrel after every firing into a horizontal position and subsequently the necessity of having to re-lay the barrel.

Another method uses a chain or telescopic ramming device, such as is described for example in patent WO-9015300. The main drawback of such ramming devices lies in their slow loading speed. Indeed, the time required to accompany the projectile and retract the device is too long and heavily prejudices the firing rate.

To overcome this drawback, ballistic ramming devices have been proposed which give the projectile a high acceleration enabling it to move through its own inertia up to the firing position in the weapon chamber.

Patent EP-0239755 describes such a device in which the acceleration is communicated to the projectile by a reducing gear lever linked to a pneumatic cylinder.

The drawback of such a device lies in the necessity of having a substantial compressed air circuit coupled with a large diameter piston. Additionally, the pivoting reducing gear lever is also cumbersome and gives the load transmitted to the projectile an orientation that varies according to the lever's angle.

Patent EP-0269560 describes a ramming device in which the acceleration is created by an impulse constituted by a hydraulic jack that drives a carriage carrying the projectile.

Such a device has the drawback of implementing a jack working in traction. This results in a large volume, since the effective surface of the piston inside the jack is annular.

This volume is further increased by the necessity of having a bulky independent high pressure accumulator. Additionally, the return to position of the jack after a shell has been pushed home is carried out by means of a second jack coaxial to the first one. The structure of such a jack is both complicated and expensive to produce.

Lastly, patent EP-0352584 describes a ramming device that accelerates a projectile placed on a slide integral with a carriage pushed by a jack. The main drawback to this ramming device is that the jack sets into motion and accelerates not only the projectile but also the slide and carriage. This design therefore requires considerable energy to ensure the positioning of the projectile. This results in impacts to the projectile and the device.

The aim of the present invention is thus to overcome the different drawbacks to the previously mentioned devices whilst providing a ramming device that possesses as few parts as possible so as to simplify its manufacture and increase its reliability.

The invention thus relates to a ramming device for artillery intended to ram a projectile into the chamber of a weapon barrel, such device comprising an impulse jack incorporating a mobile rod driving a carriage mounted able to slide with respect to a chute, the carriage being able to drive the projectile towards the weapon chamber using drive means, wherein it comprises a loading tray intended to receive the projectile, such loading tray with respect to which the carriage may translate to drive the projectile and the impulse jack is a dual-acting jack and it is the withdrawal movement of the mobile rod that is used to drive the projectile.

According to another characteristic of the invention the impulse jack is supplied with a pressurised fluid by an accumulator that comprises a cylindrical bore separated into two chambers by a free piston, a first chamber enclosing a gas and a second chamber enclosing the pressurisable fluid.

The jack and the accumulator will preferably be arranged in one and the same body integral with the chute.

According to another characteristic of the invention, the device comprises a hydraulic control unit allowing the second chamber of the accumulator to be connected either to a third or a fourth chamber of the impulse jack, said third and fourth chambers being arranged on either side of a second piston integral with the mobile rod.

The diameter of the rod will be advantageously close to that of the fourth chamber.

The hydraulic control unit may comprise at least two hydraulic valves of different throughputs, selection means allowing the second chamber to be connected to the third chamber using one or other of these hydraulic valves, thereby allowing at least two different ramming speeds to be transmitted to the projectile.

The device may comprise a pressure control system fitted with two measurement sensors, one to measure the pressure in the first chamber and the other to measure the pressure in the second chamber; these two measurements being analysed using a comparison modulus.

Advantageously, the device will incorporate a shock absorber integral with the chute and onto which one end of the mobile rod is applied at the end of its impulse stroke.

The drive means may be constituted by a push plate carried by a shaft made integral with the carriage by linking means, such shaft being substantially parallel to the chute, the linking means of the shaft allowing a limited angular movement of the shaft with respect to the chute.

The linking means of the shaft carrying the push plate may comprise at least one rubber buffer.

Advantageously, the push plate will comprise three branches intended to come into contact with a rear part of the projectile.

A first advantage of the device according to the invention lies in the fact that it allows a very high projectile loading rate whilst remaining simple and inexpensive in design.

Another advantage of the device according to the invention lies in the fact that it implements less energy than known devices to propel the projectile.

Another advantage lies in its inexpensive design.

Another advantage of the ramming device according to the invention lies in the fact that it is of relatively reduced bulk thanks to its compact design.

The ramming device also integrates a chute device that ensures the guidance of the projectile drive carriage and allows the load exerted on the projectile to be oriented.

The device according to the invention also allows several ramming speeds to be achieved for the projectiles, thereby allowing the ramming characteristics to be adapted to the elevation angle of the weapon barrel.

Figure 2:
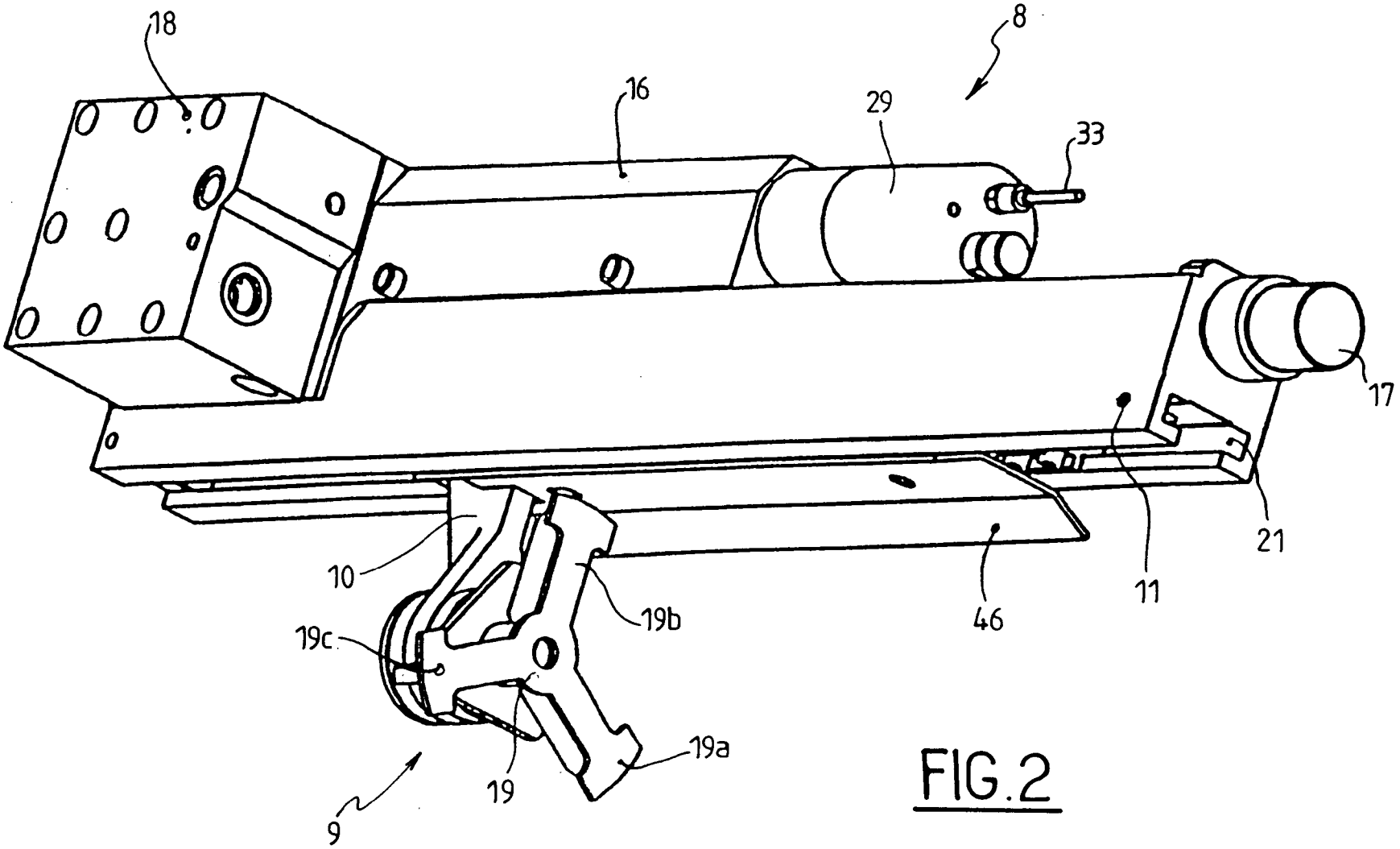
Figure 3:
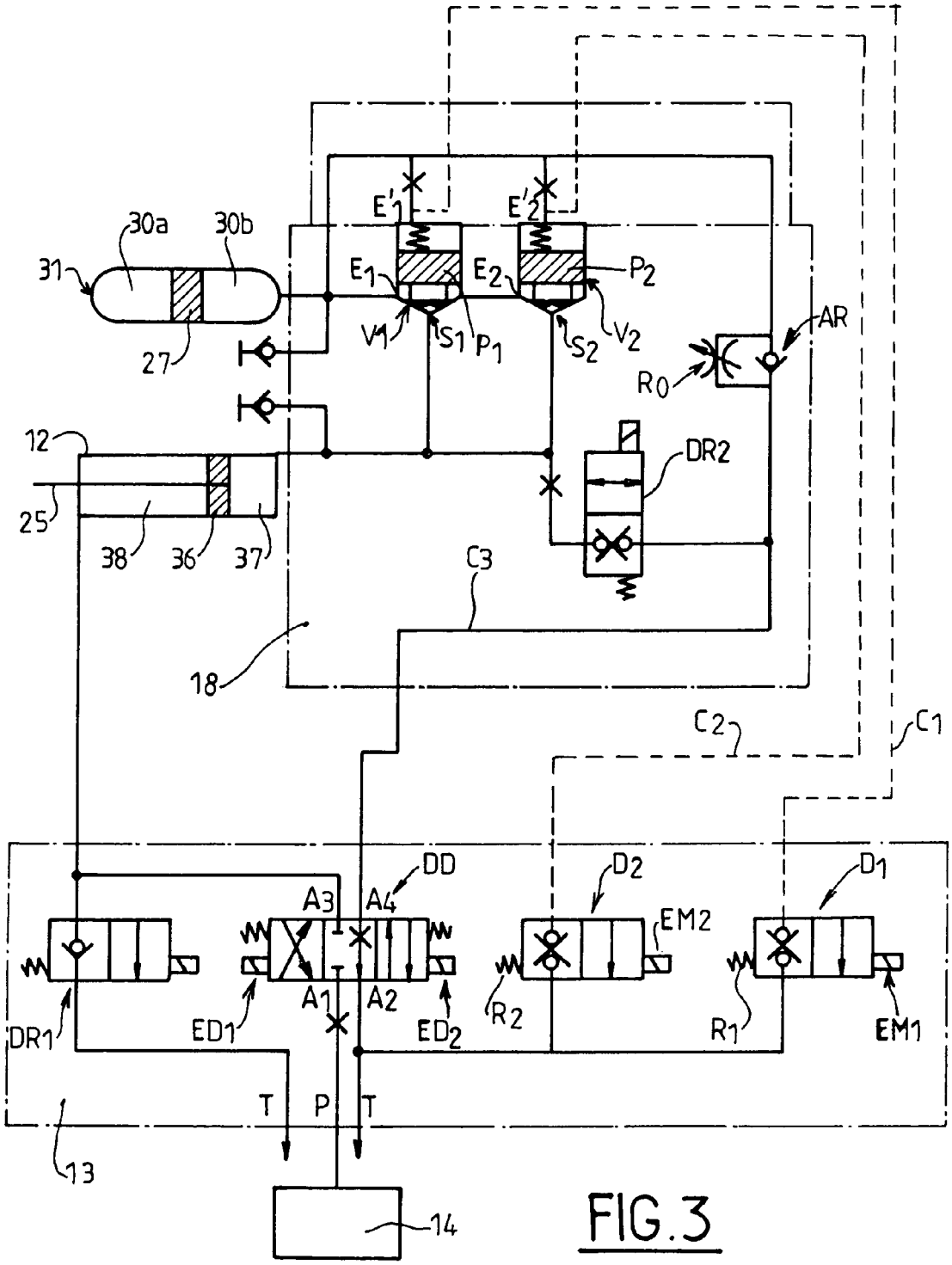
Figure 4:
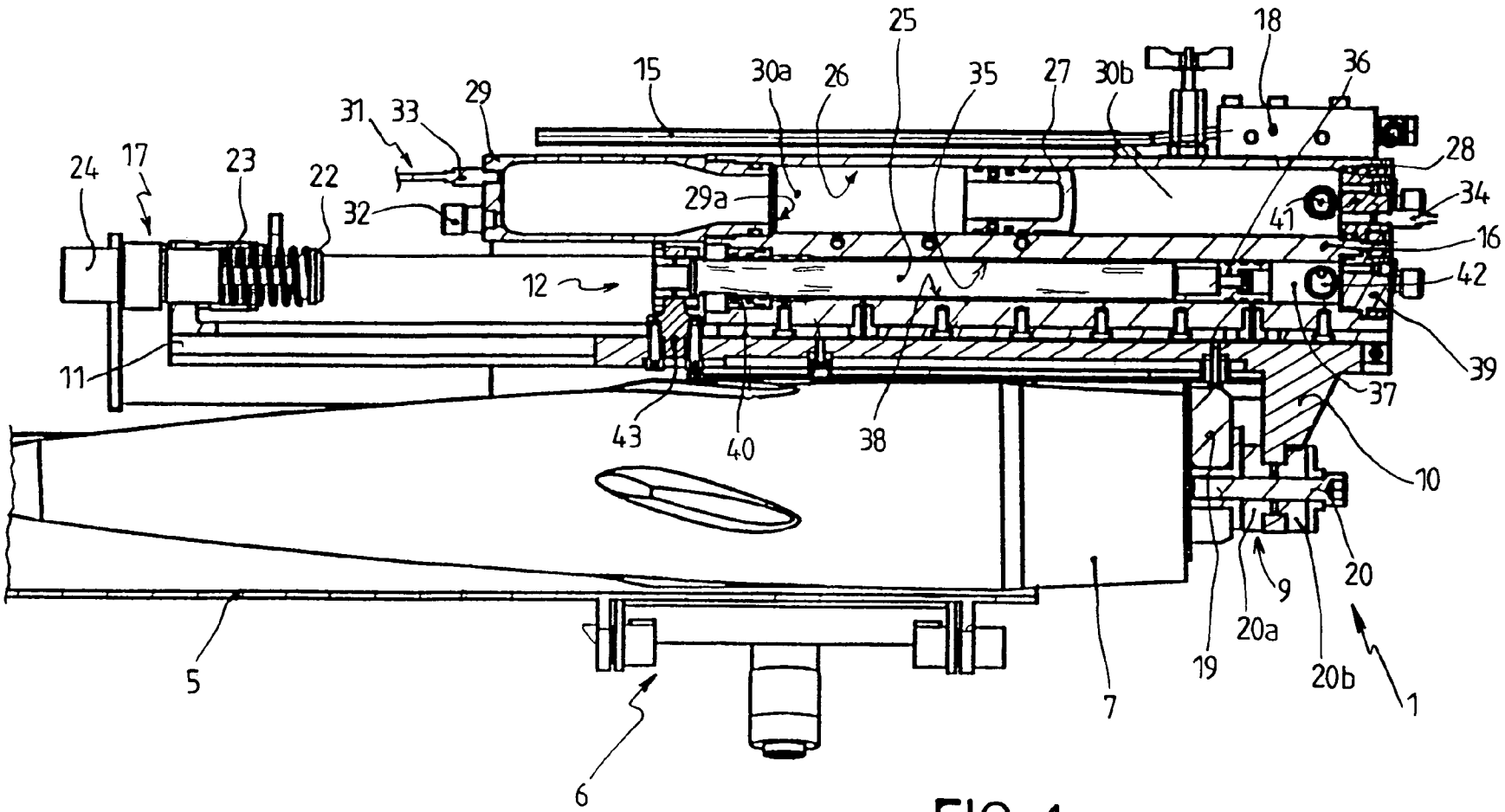
Figure 5:
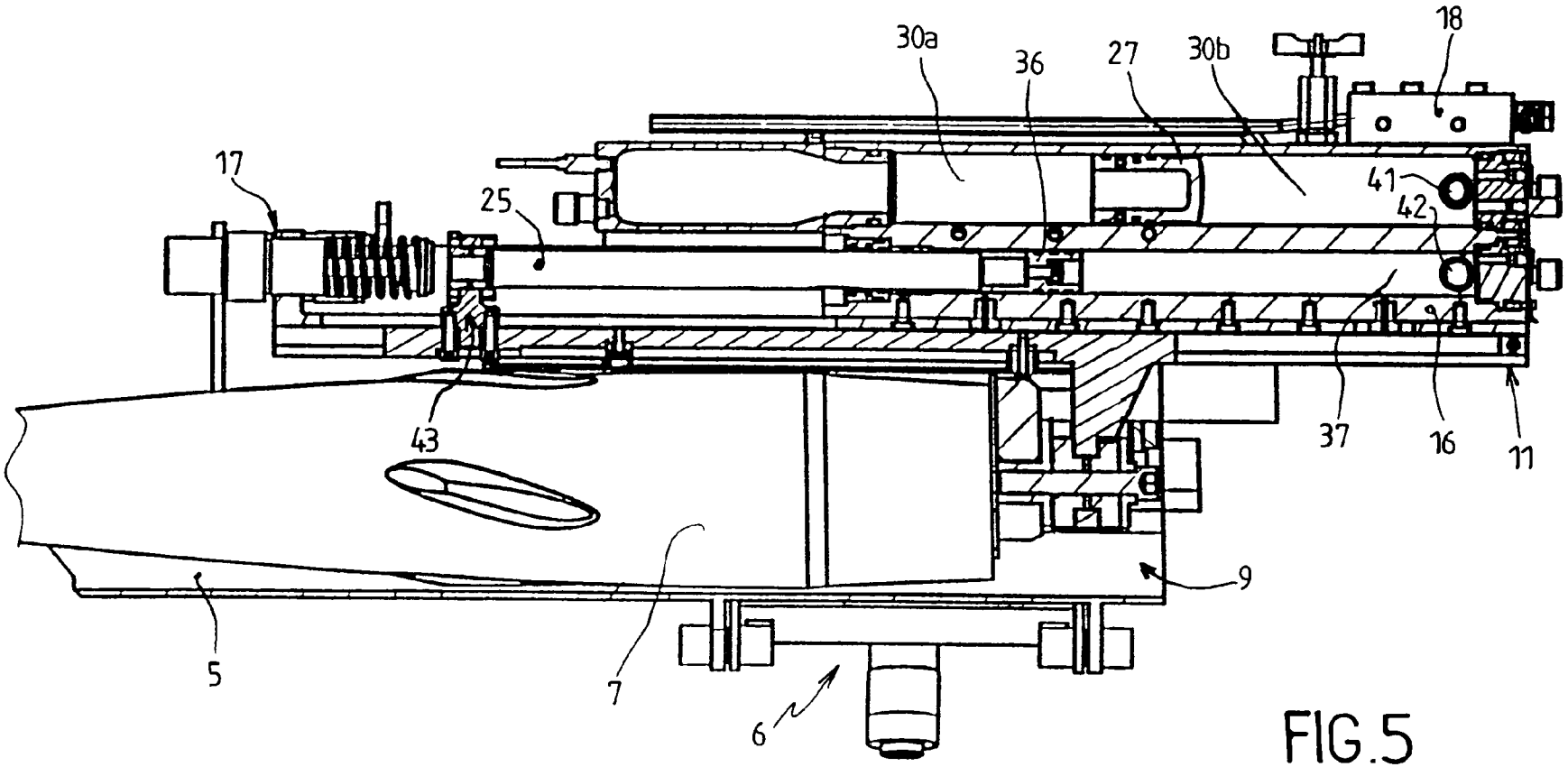
Figure 6:
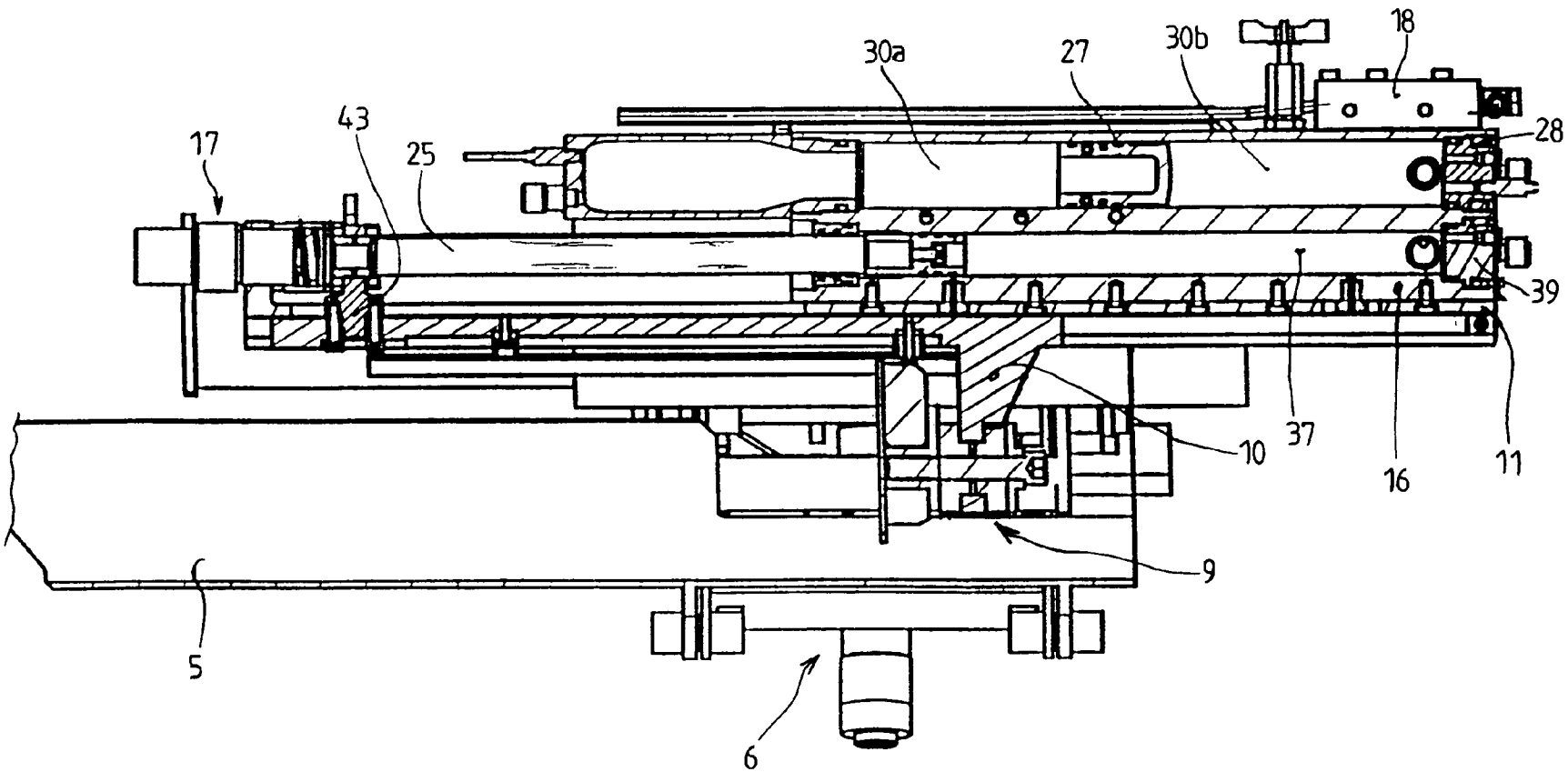
Figures 7, 8, 9:
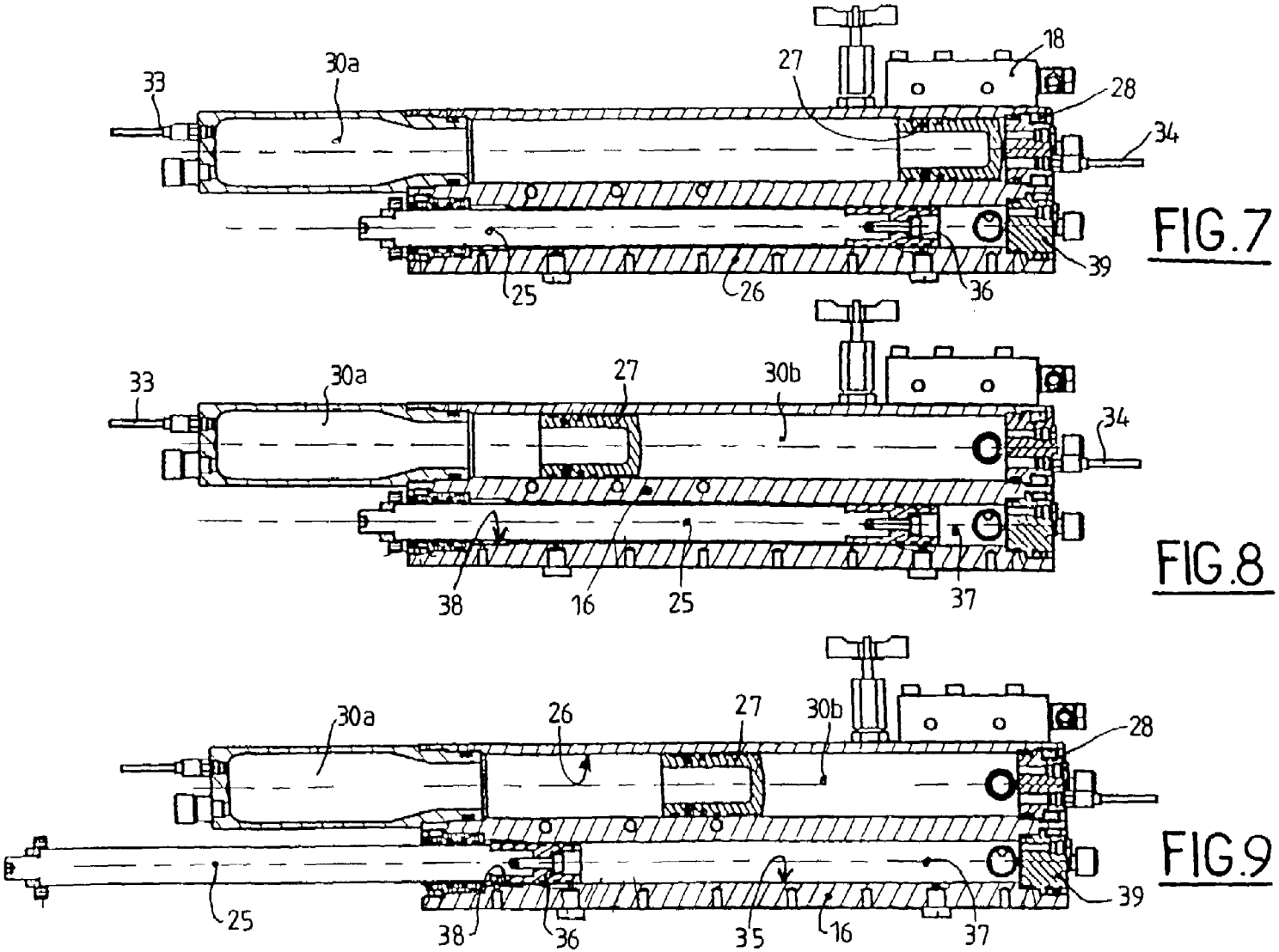
Figure 10:
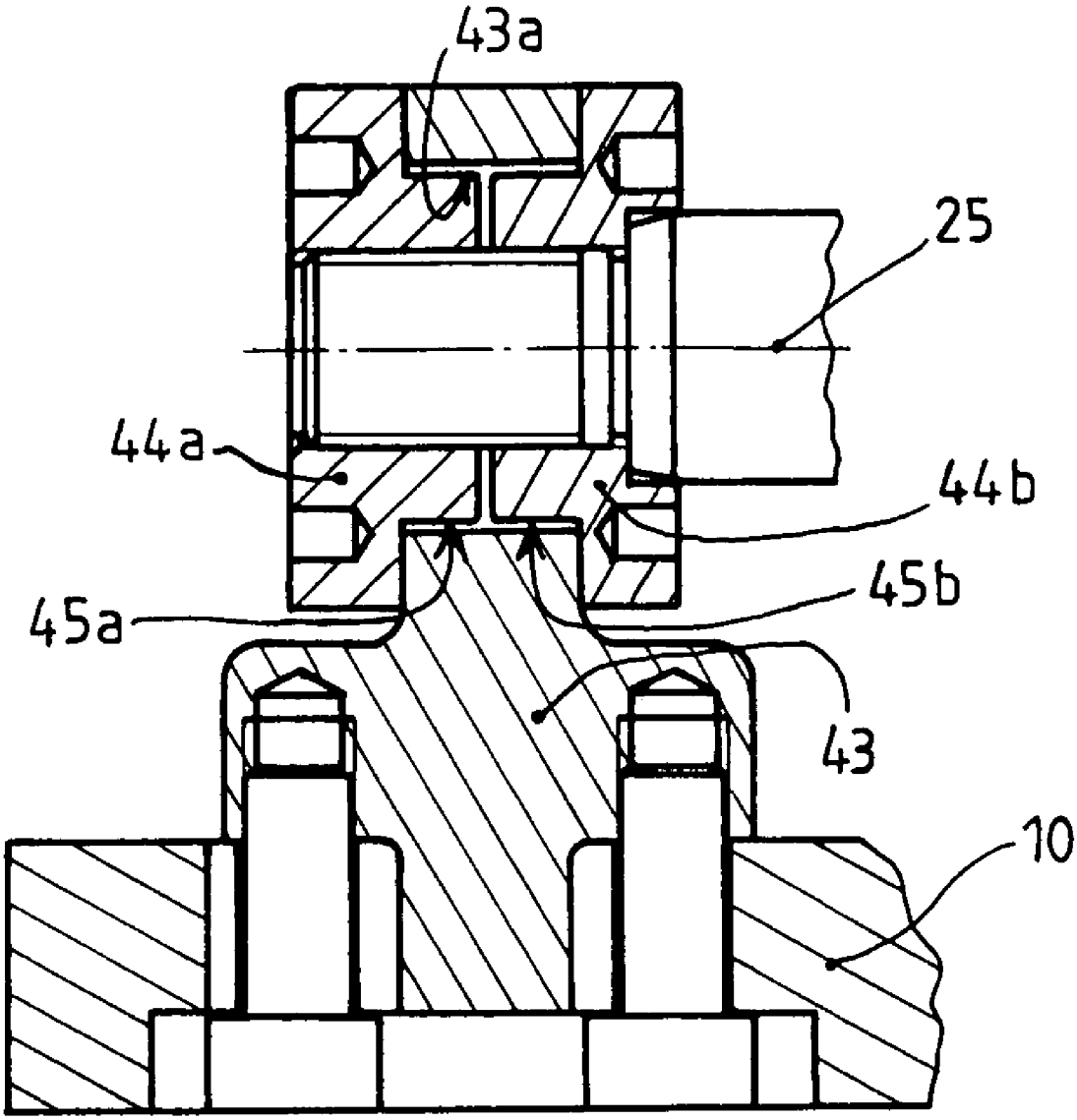

Other characteristics, particulars and advantages of the invention will become more apparent from the additional description given hereafter by way of illustration and in reference to the drawings, in which:

FIG. 1 is a view that schematically illustrates the device according to the invention mounted onto a weapon, FIG. 2 shows a general perspective view of the device according to the invention shown alone, FIG. 3 shows a circuit diagram of the hydraulic controls of the device, FIG. 4 shows a side section view of the ramming device in a phase of its operation in which it is ready to propel, FIG. 5 is a side section view of the device mounted on the loading tray in the propulsion phase, FIG. 6 is a side section view of the device mounted on the loading tray during the phase at the end of the propulsion operation, FIGS. 7, 8 and 9 are section views illustrating the hydro-pneumatic functioning principle of the propulsion means, and FIG. 10 is a detailed section view of the fastening of the carriage at one end of the jack rod.

FIG. 1 shows a ramming device 1 according to the invention integrated onto a weapon that classically comprises a barrel 2 and a breech ring 3 as well as a cradle 4 that receives the barrel in a sliding manner.

The ramming device 1 comprises a loading tray 5 that is integral with the cradle 4 of the weapon and that is intended to receive a projectile 7. To allow the projectile to be positioned, the loading tray may tilt with respect to the cradle 4 by means of a hinge 6. The ramming device 1 also comprises impulse means 8 comprising drive means 9 integral with a carriage 10 mounted able to slide with respect to a chute 11. The impulse means are integral with the cradle 4 of the weapon with respect to which they are able to tilt on a hinge (not shown) so as to be able to be positioned above the loading tray 5.

The impulse means 8 also comprise an impulse jack 12 intended to drive the carriage 10. Said carriage pushes the projectile 7 towards the chamber 13 of the weapon using the drive means 9 that are applied to the base of the projectile 7.

The impulse means are connected to a hydraulic unit 14 (carried by the weapon system) by means of piping 15 and a hydraulic supply unit 13.

FIG. 2 shows a more detailed top view of the impulse means 8. The carriage 10 is mounted able to slide in the chute 11 that is integral with a body 16. The chute 11 is provided at one end with a shock absorber 17. The body 16 carries a hydraulic control unit 18 that is connected by piping 15 (not shown in FIG. 2) to the supply unit 13 and which contains the components required for the ramming device to function.

The hydraulic components are, for example, electrovalves or electro-distributors of a known type that are automatically controlled. The internal structure of the hydraulic control unit will be described later with reference to FIG. 3.

A section view of the ramming device is shown in FIG. 4. The device is shown in the "before impulse" position. A projectile 7 is placed on the loading tray 5 and the drive means 9 are applied to the projectile base.

These drive means 9 are constituted by a push plate 19 carried by a shaft 20 made integral with the carriage 10 by linking means. The shaft 20 is substantially parallel to the chute 11.

The linking means comprise two rubber buffers 20*a*, 20*b*. Because of their flexibility, these buffers allow a limited angular movement of the shaft 20 with respect to the chute 11.

Additionally, the push plate 19 comprises three branches 19*a*, 19*b*, 19*c* (see FIG. 2) intended to come into contact with the projectile base.

The flexible positioning of the plate 19 is thereby ensured allowing a contact with the base at three points. This results in the improved control of the orientation of the load applied by the ramming device to the projectile.

The chute 11 is screwed into the body 16. It incorporates a rectangular longitudinal groove 21 (see FIG. 2) inside which a matching profile of the carriage is able to slide. The surface of this profile is coated in bronze so as to make it easier for it to slide.

Additionally, a metal plate 46 is integral with the carriage 10 and separates it from the projectile 7. It ensures the positioning of the projectile along an axis substantially parallel to that of the chute whilst avoiding friction between the projectile and the chute 11.

At its front part, the chute has a shock absorber 17. This shock absorber is of the hydraulic type and incorporates in a known manner a finger 22 mounted sliding in a chamber 24 filled with oil. A return spring 23 ensures that the finger returns to its protruding position after the shock absorbing operation.

This shock absorber 17 constitutes an abutment for a rod 25 of the hydraulic jack 12. It is fixed with respect to the chute 11. This hydraulic type element may be replaced by a mechanical shock absorber of a known type.

As may be seen in FIG. 4, the body 16 comprises two parallel bores.

A first longitudinal bore 26 is closed at one end by a plate 28 and at the other by a cylinder 29 screwed into the body 16.

A first bore 26 receives a free piston 27 that is provided with sealing rings and slides freely in this bore. On one side this piston delimits a first chamber 30*a* with the inner volume of the cylinder 29, and on the other side a second chamber 30*b* closed by the rear plate 28. One front end 29*a* of the cylinder 29 constitutes an axial abutment for the free piston 27.

The first chamber 30*a* receives a gas such as nitrogen and the second chamber receives a pressurisable fluid such as oil. This first bore thereby constitutes an accumulator 31 able to supply the impulse jack 12 with pressurised fluid.

So as to allow it to be filled with the gas, the first chamber is provided with a valve 32.

A first pressure sensor 33 is fastened to the cylinder 29. It is connected to an electronic control device (not shown) and allows the pressure of the gas filling the first chamber 30*a* to be measured.

A second pressure sensor 34 is fastened to the rear plate 28. It is also connected to the electronic pressure control device and allows the pressure of the oil filling the second chamber 30*b* to be measured.

These sensors allow the state of the accumulator 31 to be controlled. The pressure measured by these two sensors must be the same (balance of the mobile piston 27). A gas leak brings the free piston 27 up against the front end 29*a* of the cylinder 29. This results in a pressure imbalance between the two chambers that may be seen thanks to the sensors.

When the pressures measured are equal to each other and to that supplied by the hydraulic system the impulse may be made to function.

The ramming device according to the invention thus has improved operational safety. This is directly linked to the use of a free piston accumulator, said piston in abutment allowing a drop in gas pressure or the blockage of a piston to be visualised.

The body 16 also comprises a second longitudinal bore 35 in which the rod 25 of the hydraulic jack 12 slides. At its internal end, the rod has a second piston 36 fitted with sealing rings. The second piston 36 shares the second bore 35 in a third 37 and fourth 38 chamber. The latter is of a diameter close to that of the rod 25 (around 32 mm for a rod diameter of 28 mm). It is thus not easy to see in the Figures. Such an arrangement, by reducing the volume of the fourth chamber, allows the volume of fluid that must be ejected from it when the rod comes out of the jack 12 to be heavily reduced. The output of the impulse is thus improved.

The rear end of the second bore 35 is closed and sealed by a rear plate 39 fitted with sealing rings. The front end of the second bore 35 allows the rod 25 of the jack to pass through a ring 40 fitted with a sealing ring.

The jack 12 and the accumulator 31 are thus arranged in one and the same body 16 integral with the chute 11.

Advantageously, the axes of bores 26 and 35 are parallel to each other.

The second chamber 30*b* and the third chamber 37 are connected to one another by means of the hydraulic control unit 18. In practical terms they are connected by piping (not shown) that links openings 41 and 42 seen in FIG. 4.

The front end of the rod 25 of the jack is connected by the carriage 10 by means of a linking element 43 that may be seen in greater detail in FIG. 10.

This element has a perforation 43*a* whose diameter is greater (by at least 2 millimeters) than that of flanges 45*a* and 45*b* of two linking nuts 44*a*, 44*b*. Such an arrangement allows a certain freedom in the radial positioning of the linking element 43 with respect to the rod 25. Any deviations in size can be therefore made up for during assembly. Nuts 44*a* and 44*b* are both screwed onto the end of the rod 25 of the jack. They pinch the linking element 43 and ensure the rigidity of the link whatever the relative radial position of the element 43 and the rod 25. The carriage 10 is fastened to the linking element 43 by screws.

The jack 12 is a dual-acting jack. Oil pressure in the third chamber 37 causes the rod 25 to come out and ensures the positioning of the projectile. In this case the jack works by pushing.

On the contrary, oil pressure in the fourth chamber 38 causes the retraction of the rod 25 inside the jack to allow another projectile to be positioned.

We note that the operation of ramming a projectile into place (which requires the most speed) is carried out during the withdrawal of the rod. This choice allows less hydraulic pressure to be used since the surface of the second piston 36 onto which the hydraulic pressure is exerted is equal to the diameter of the second bore 35 (diameter of the third chamber 37). The return movement of the rod 25 on the other hand uses the annular surface between the rod 25 and the second piston 36. This surface is less and the return speed is also less.

With respect to known devices (for example in EP269560) that use jacks in traction, the choice of using a hydraulic jack that works in "push" mode to ram a projectile into place, at equivalent speed performances, allows the volume of the hydraulic jack to be reduced thereby reducing the overall bulk of the whole ramming device.

It also allows us to simplify the structure of the device.

The hydraulic control unit 16 allows the second chamber 30*b* of the accumulator 31 to be selectively connected to the third 37 or fourth 38 chamber of the impulse jack 12.

FIG. 3 shows an example circuit diagram of the hydraulic part of the device.

This Figure schematically illustrates the accumulator 31 as well as the dual-acting jack 25. Those components belonging to the hydraulic control unit 18 and those of the hydraulic supply unit 13 are presented in rectangles with dotted sides.

The hydraulic control unit 18 encloses two hydraulically controlled valves V1 and V2. These valves are well known to the expert. They comprise a piston (P1 or P2) blocking an outlet opening (S1, S2), such piston that is normally in a state of equilibrium in the closed position for the valve when the pressure is the same on either side of the piston. Here each valve receives at its inlets E1 and E'1 (respectively E2 and E'2) the hydraulic pressure of the second chamber 30*b* of the accumulator.

Each of these valves V1 or V2 has different throughput characteristics. Valve V1 will, for example, be a high throughput valve (around 300 liters/minute) and valve V2 will have a lower throughput (around 200 liters/minute). Outlets S1 and S2 of valves V1 or V2 are connected to the third chamber 37 of the jack 12. Therefore, if valve V1 is activated, the fluid throughput from the accumulator 31 to the jack 12 will be greater than that obtained if valve V2 is activated. Two different withdrawal speeds may therefore be obtained for the rod 25 of the jack 12. This results in two different ramming speeds to position the projectile in the chamber. The higher speed (of around 8 m/s for the projectile) will be used when the weapon barrel has a high elevation angle (angle of around 35° to 40°). It is naturally possible for a device comprising more than two hydraulically controlled valves V to be defined which thus allow more than two ramming speeds.

Each valve is controlled by the hydraulic supply unit 13. To this end, said unit encloses two electrically controlled hydraulic distributors D1 and D2 respectively connected to inlets E'1 and E'2 of valves V1 and V2 by piping C1 and C2 (in dotted lines).

In a manner known to the expert, such a distributor comprises a slide valve able to occupy two positions. The starting position is the one shown in FIG. 3. Each distributor passes into its active position by the control of an electromagnet EM1 or EM2. It returns to its starting position when the electromagnet is released by the action of a return spring (R2 or R1).

Control electronics (not shown) will activate the distributor D1 or D2 depending on operational requirements. When a slide valve of the distributor is moved, the inlet E'1 or E'2 of the valve to which it is associated with be connected to the "tank" T (oil container). A pressure imbalance is thus created in the valve in question on either side of the plunger, the effect of which is to open the valve.

The hydraulic supply unit also encloses a rearming distributor DR1, which, like the other distributors, is activated by an electromagnet and incorporates a return spring. This distributor is shown here in the starting position, which corresponds to that adopted for rearming. When the impulse is controlled by one or other of the distributors D1 or D2, distributor DR1 is also activated (at the same time or slightly before), the effect of which is to connect the fourth chamber 38 of the jack 12 to the oil tank T. Thus, all the oil in the fourth chamber is evacuated by the movement of the piston 36 and is unable to prevent the impulse jack 12 from functioning.

The hydraulic control unit 18 also encloses another rearming distributor DR2. This distributor is shown in FIG. 3 in the starting position. It is activated after the rod 25 has withdrawn from the jack so as to allow it to return to its starting position. Indeed, it allows the third chamber 37 to be connected to the oil tank T via a double distributor DD thereby allowing the rod 25 of the jack 12 to return to the armed position.

The double distributor DD is placed in the hydraulic supply unit 13. It is classically constituted by a slide valve able to adopt three positions thanks to two electromagnets (ED1 and ED2): a starting position (in FIG. 3), a first active position through the activation of electromagnet ED1 (slide valve moved towards the right in FIG. 3), and a second active position through the activation of electromagnet ED2 (slide valve moved towards the left in FIG. 3).

Inlets A1 and A2 of this distributor are respectively connected to the hydraulic unit 14 and to the oil tank T. Inlet A3 is connected to the fourth chamber 38 of the jack 12 and inlet A4 is connected to the rearming distributor DR2 and to valves V1 and V2.

The double distributor DD is shown in the starting position in FIG. 3. This position is associated with the operation in impulse mode of the jack 12 (withdrawal of the rod 25). When rearming is required, electromagnet ED2 is activated, the effect of which is to connect inlets A1 and A3 whilst connecting inlets A2 and A4. Thus, the hydraulic unit 14 is connected to the fourth chamber 38 of the jack, thereby retracting the rod 25 inside the jack. At the same time (distributor DR2 having been activated at the same time), the third chamber 37 is connected to the oil tank T via inlets A4 and A2 and distributor DR2.

Electromagnet ED1 is activated when the oil accumulator needs to be filled before a new impulse. Inlets A2 and A3 are in this case connected whereas inlets A1 and A4 are connected to one another. The hydraulic unit 14 is in this case directly connected to the second chamber 30*b* of the accumulator 31 via piping C3 and a non-return valve AR. Reference RO in FIG. 3 corresponds to a manual drain cock for the hydraulic circuit. When this is open and when the double distributor DD is in its starting position (such as seen in the Figure) the oil contained in the accumulator 31 is evacuated towards the tank T through piping C3.

The operation of the ramming device according to the invention will now be explained with reference to FIGS. 4 to 9.

FIG. 4 shows the ramming device according to the invention in a phase of operation in which the projectile is about to be propelled into the weapon chamber 13. The carriage 10 is in the retracted position, which is to say substantially against the rear end of the body 16 opposite the shock absorber 17. The projectile 7 is installed on the loading tray 5.

FIG. 5 shows the device during a propulsion phase of the projectile. The hydraulic control unit 18 has been activated so as to allow pressurised oil to pass from the second chamber 30*b* to the third chamber 37. The rod 25 of the jack withdraws from its bore 35. It drives the carriage 10 which pushes the projectile thanks to the drive means 9 applied to the projectile 7 base. The projectile slides on the loading tray 5, which remains immobile. The projectile is projected towards the weapon chamber and becomes wedged in the forcing cone.

FIG. 6 shows the device after the projectile has left the loading tray 5. The rod 25 of the jack 12 is at its maximum extension. It is halted in its translation by the shock absorber 17, which brakes its movement. The carriage 10 and the drive means 9 are in their final ramming position.

We note that, during all the phases, the loading tray 5 and the shock absorber 17 remain immobile with respect to the cradle. The mobile part is constituted by the piston rod 25 and by the carriage 10 carrying the drive means 9. The energy implemented to propel the projectile is thereby reduced as are the shocks received by the projectile and the ramming device.

FIGS. 7, 8 and 9 show the hydro-pneumatic operation of the ramming device as well as its safety positioning.

FIG. 7 shows the device in a phase of prolonged inactivity or in the rest position. The first chamber 30*a* is filled with nitrogen at a pressure of around 90 bars. The oil pressure in the second chamber 30*b* and in the third chamber 37 is substantially nil. The free piston 27 presses against the rear plate 28. In this rest position, the mobile rod 25 of the hydraulic jack 12 is in the retracted position.

FIG. 8 highlights how the ramming device 1 is trimmed with oil. The oil is injected into the second chamber 30*b* by the hydraulic unit 14 (see FIG. 1) and by means of the hydraulic supply unit 13 and the control unit 18. The chamber 30*b* is filled with oil until reaching an internal pressure substantially equal to 160 bars. The free piston 27 then moves to the left, with respect to FIG. 7, until the pressure between the first chamber 30*a* and the second chamber 30*b* is equilibrated. During this preparatory phase, the pressure in the third chamber 37 is still substantially nil. The device according to the invention is now ready to propel the projectile.

As was specified before, the prepared state is verified thanks to the pressure sensors 33 and 34, which must indicate the same pressure value. This method represents the pressure control means to secure the oil and/or nitrogen trimming of the device. These pressure values are compared by a modulus (not shown) that sends the data to an operator.

FIG. 9 shows the device according to the invention at the end of its propulsion phase. The hydraulic supply unit has controlled the opening of one or other of valves V1 or V2, thereby connecting the second chamber 30*b* of the accumulator to the third chamber 37 of the jack 12. The mobile rod 25 of the jack has moved so as to push the projectile.

To ensure a return to the phase where the projectile is about to be propelled, oil is injected into the fourth chamber 38 thereby making the mobile rod 25 retract into the bore 35.

The oil and/or nitrogen trimming is secured as is the functioning by controlling the pressures. Indeed, whatever the unwanted event, for example the free piston 27 becoming blocked, nitrogen or oil leaking from the first and second chamber via the free piston 27, external nitrogen leak, the resulting pressure imbalance will be detected by the pressure sensors 33 and 34.

What is claimed is:

1. A ramming device for artillery intended to ram a projectile into the chamber of a weapon barrel, said device comprising an impulse jack incorporating a mobile rod driving a carriage mounted able to slide with respect to a chute, the carriage being able to drive the projectile towards the weapon chamber using drive means said device also comprising a loading tray for receiving the projectile, said loading tray with respect to which the carriage may translate to drive the projectile, a push plate integrated to the carriage, and a metal plate for positioning the projectile along an axis substantially parallel to the chute while avoiding friction between the projectile and the chute.

2. A ramming device for artillery according to claim 1, wherein the impulse jack is a dual-acting jack permitting the withdrawal movement of the mobile rod to drive the projectile.

3. A ramming device for artillery according to claim 2, wherein the impulse jack is supplied with a pressurised fluid by an accumulator comprising a cylindrical bore separated into two chambers by a free piston, a first chamber enclosing a gas and a second chamber enclosing a pressurisable fluid.

4. A ramming device for artillery according to claim 3, wherein the jack and the accumulator are arranged in and as a single body integral with the chute.

5. A ramming device for artillery according to claim 4, further comprising a hydraulic control unit allowing the second chamber of the accumulator to be connected either to a third or a fourth chamber of the impulse jack, said third and fourth chambers being arranged on either side of a second piston integral with the mobile rod.

6. A ramming device for artillery according to claim 5, wherein the diameter of the mobile rod is close to that of the fourth chamber.

7. A ramming device for artillery according to claim 5, wherein the hydraulic control unit comprises at least two hydraulic valves of different throughputs, selection means allowing the second chamber to be connected to the third chamber using one or the other of these hydraulic valves, thereby allowing at least two different ramming speeds to be transmitted to the projectile.

8. A ramming device for artillery according to claim 3, further comprising a pressure control system fitted with two measurement sensors, one to measure the pressure in the first chamber and the other to measure the pressure in the second chamber, these two measurements being analysed using a comparison modulus.

9. A ramming device for artillery according to claim 1, further comprising a shock absorber integral with the chute and onto which one end of the mobile rod is applied at the end of its impulse stroke.

10. A ramming device for artillery according to claim 1, wherein the drive means comprise a push plate carried by a shaft made integral with the carriage by linking means, said shaft being substantially parallel to the chute, the linking means of the shaft allowing a limited angular movement of the shaft with respect to the chute.

11. A ramming device for artillery according to claim 10, wherein the linking means comprise at least one rubber buffer.

12. A ramming device for artillery according to claim 10, wherein the push plate comprises three branches intended to come into contact with a rear part of the projectile.

* * * * *